United States Patent [19]

Buscella

[11] Patent Number: 4,992,913

[45] Date of Patent: Feb. 12, 1991

[54] LIGHT-BULB HOLDER FOR HOUSEHOLD APPLIANCES

[75] Inventor: Claudio Buscella, Verolengo, Italy

[73] Assignee: ITW Fastex Italia, S.p.A., Turin, Italy

[21] Appl. No.: 489,630

[22] Filed: Mar. 7, 1990

[30] Foreign Application Priority Data

Mar. 10, 1989 [IT] Italy ..... 52929/89[U]

[51] Int. Cl.[5] ..... F21V 33/00

[52] U.S. Cl. ..... 362/94; 362/155; 315/84; 200/61.76

[58] Field of Search ..... 362/94, 95, 155; 315/84; 200/61.76, 61.81, 61.82

[56] References Cited

U.S. PATENT DOCUMENTS 2,930,885 3/1960 Ehrenfreund ..... 362/94

*Primary Examiner*—Carroll B. Dority

*Attorney, Agent, or Firm*—Schwartz & Weinrieb

[57] ABSTRACT

The invention relates to a light-bulb holder for household appliances in general, and refrigerators and freezers in particular, comprising a board structure fabricated from an electrically insulating material and bounded by a peripheral edge and a pair of oppositely disposed lateral surfaces, and an electrically conductive plate divided into sections so as to define an electrical circuit and disposed inside the board structure. The board structure is equipped with an integrally formed and peripherally projecting sleeve for holding a light bulb, and from which respective electrical supply terminals project sideways, and the board also supports a pivotable lever, pivoted freely against the action of a spring, and disposed at right angles with respect to the plane of the board structure, and supported by means of a pin disposed parallel to the lateral surfaces and equipped at one end with a transverse electrically conductive pin adapted, at a travel end position at which the lever is held by means of the spring, to come into contact with a pair of electrical contacts housed transversely within a hole passing through the structure, so as to close the circuit.

8 Claims, 2 Drawing Sheets

LIGHT-BULB HOLDER FOR HOUSEHOLD APPLIANCES

FIELD OF THE INVENTION

The present invention relates to a light-bulb holder particularly suitable for use upon household appliances, and in particular upon refrigerators and freezers.

BACKGROUND OF THE INVENTION

Internal illumination of household appliances, such as, for example refrigerators, by means of light bulbs disposed within light-bulb holders the only function of which is to support the light bulb and which thus require, during installation upon the household appliance, a set of other accessories, such as, for example a door-switch for switching off the light when the refrigerator door is closed, are of course known; and while this type of light-bulb holder has a low cost and occupies little space it requires complex assembly and cabling procedures because it must be functionally and electrically connected to the accessories.

Built-in light-bulb holders which incorporate a door switch and perform additional functions, such as, for example, providing a support for thermostats and terminal boards, are also known. These built-in light-bulb holders have a high cost and/or are too complex for use upon basic household appliances.

OBJECT OF THE INVENTION

It is the object of the present invention to provide a light-bulb holder of limited dimensions, that occupies little space and is easy to connect to and assemble upon the household appliance, so that it may be advantageously used upon all household appliances, whether sophisticated or basic.

SUMMARY OF THE INVENTION

According to the present invention, there is provided a light-bulb holder for household appliances, of the type comprising a board structure fabricated from an electrically insulating material, bounded by means of a peripheral edge and a pair of oppositely disposed lateral surfaces; an electrically conductive plate divided into sections and adapted to define an electrical circuit comprising a pair of power supply contacts, and disposed inside the board structure so as to be parallel to the oppositely disposed lateral surfaces; selective electrical supply means for the circuit; and an incorporated light-bulb holder sleeve projecting from the board structure in line with a first hole passing through the lateral surfaces of the board structure, the first hole communicating with the inside of the sleeve and housing the power supply contacts projecting internally into the first hole; characterized in that the selective electrical supply means comprises at least one pair of electrical plate terminals integrally formed with the conductive plate and projecting out of the board structure, a pair of second electrical contacts disposed transversely within a second hole passing through the surfaces of the board structure, and a pivotable lever made to rotate against the action of an elastic means by the board structure about a fulcrum disposed substantially parallel to the lateral surfaces; the rock lever having a first end set in line with said second hole and equipped transversely with an electrically conducting element, which is disposed parallel to the fulcrum and being adapted, in a first travel end position of the lever, to come simultaneously into contact with both of the second electrical contacts.

BRIEF DESCRIPTION OF THE DRAWINGS

The invention will be described by way of example, as incorporated within the embodiment of this invention which will be described in detail hereinbelow, with reference being made to the accompanying drawings, in which like reference characters designate like or corresponding parts throughout the several views, and wherein.

DETAILED DESCRIPTION OF THE INVENTION

Figure 2:
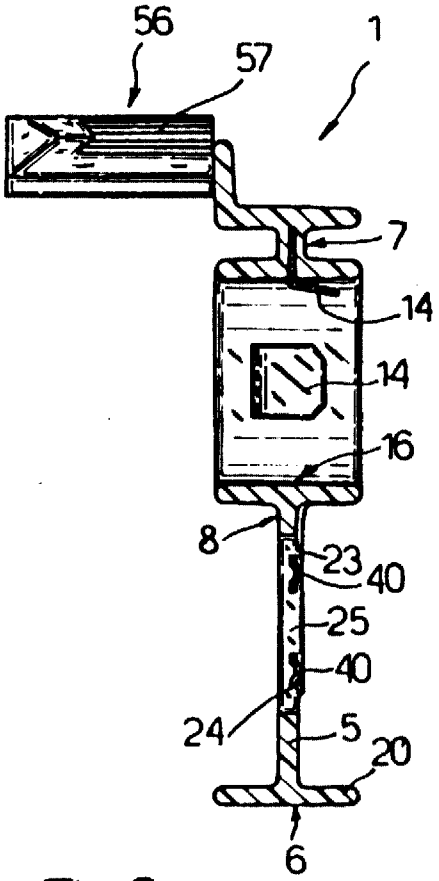
FIGS. 2, 3, 4, and 5 are sectional views along lines 2—2, 3—3, 4—4 and 5—5 of the light-bulb holder shown in FIG. 1.

With reference being made to the drawings mentioned above, numeral 1 indicates a light-bulb holder, in its entirety, for a lamp or electrical light bulb 2 adapted for installation within a household appliance, such as, for example a refrigerator, disposed within a container box of a known type, indicated in its entirety by numeral 3. Light-bulb holder 1 comprises a board structure 5 made from an electrically insulating material, obtained for example by molding a synthetic plastic material, which has a substantially L-shaped elevated form, the structure comprising a pair of parts or wings 21 and 22 disposed at rights angles with respect to each other, and being bounded by means of a peripheral edge 6 and a pair of oppositely disposed lateral surfaces 7 and 8. Light-bulb holder 1 also comprises an electrically conductive plate 10, which is disposed inside board structure 5 so as to be parallel to sides 7, 8 and is divided into sections, such as, for example into three sections 11, 12 and 13, which are adapted to define an electrical circuit comprising a pair of power supply contacts 14 for light bulb 2. Light-bulb holder 1 further comprises selective electrical supply means for the electrical circuit defined by means of sections 11, 12 and 13 and a light-bulb holder sleeve 15 integrally formed with and projecting peripherally from structure 5 in line with a first hole 16 passing through lateral surfaces 7, 8 at right angles to the surfaces. Hole 16, which is substantially rectangular in form, communicates with the inside of sleeve 15, is axial with respect to the sleeve, which is preferably slightly inclined outwardly and downwardly towards lower wing 22, and is adapted to accommodate the stem of light bulb 2 during use and has internally projecting contacts 14. For stiffening purposes, hole 16 is bounded by means of a bead 18 and edge 6 is defined by means of a bead 20 that projects perpendicularly from both lateral surfaces 7 and 8 and bounds both wings or parts 21 and 22 of structure 5.

In accordance with the invention, the selective electrical supply means for the circuit defined by sections 11, 12 and 13 of plate 10 comprises at least one pair of electrical plate terminals 30, for example of the "Faston" type, integrally formed with plate 10 and projecting out of structure 5, a pair of additional electrical contacts 23 and 24 disposed transversely inside a second hole 25, which is substantially rectangular and machined perpendicularly through surfaces 7, 8 and a pivotable lever 28 supported so as to rotate against the action of elastic means of structure 5 about a fulcrum 32 disposed substantially parallel to surfaces 7, 8. Contacts 23 and 24 are disposed upon different sections of plate 10, in particular contact 23 is disposed upon section 12, which also includes one of contacts 14, while contact 24 is disposed upon section 13 which also includes one of the electrical terminals 30; the other terminal 30 and the other contact 14 are disposed upon section 11. Pivotable lever 28 also has a first end 29 disposed in line with hole 25 and and is with a transverse electrically conductive element 31 disposed parallel to fulcrum 32 and adapted to interact with contacts 23, 24 so as to establish an electrical connection therebetween.

Figure 5:
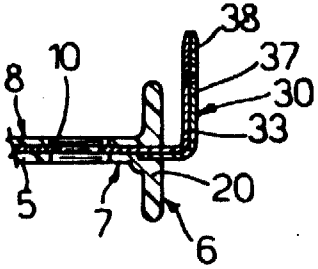

In particular, electrical terminals 30 are defined by means of respective fins 33 projecting at right angles with respect to bead 20, upon the side opposite sleeve 15 and parallel to lateral surfaces 7, 8, fins 33 having respective ends 38 bent sideways at right angles so that they are disposed so as to project at right angles with respect to surface 8, whereby they actually define the real terminals 30. Fins 33 may be strengthened by fitting them with shims 37 as seen in FIG. 5. Electrical contacts 23, 24 are defined by means of a pair of parallel jumpers extending transversely across hole 25 and equipped, upon the side disposed towards lever 28, with respective bosses 40 adapted to facilitate contact with conducting element 31.

Lever 28 is defined by means of a plate with a substantially asymmetrical C-shaped configuration disposed orthogonal to structure 5, pivoted freely upon a pin 32, which projects perpendicularly from peripheral edge 6, so as to be movable from the upper side of lower wing 22 of structure 5, parallel to upper wing 21, which is equipped with hole 16 and sleeve 15. Pin 32 is disposed substantially at the same height as hole 25, which is positioned substantially between the two wings 21 and 22, and one end 29 of lever 28 is shaped so that it fits through hole 25, between jumpers 23 and 24, when the lever 28 is disposed at a first travel end position, illustrated by means of the continuous line in FIG. 4. The conductive element supported by means of end 29 of lever 28 is defined, in the embodiment illustrated, by means of a metal pin 31 disposed so as to project transversely through end 29, at right angles to the plane of lever 28, and adapted to come into contact simultaneously with both jumpers 23, 24 when lever 28 is disposed at the first travel end position.

Figure 3:
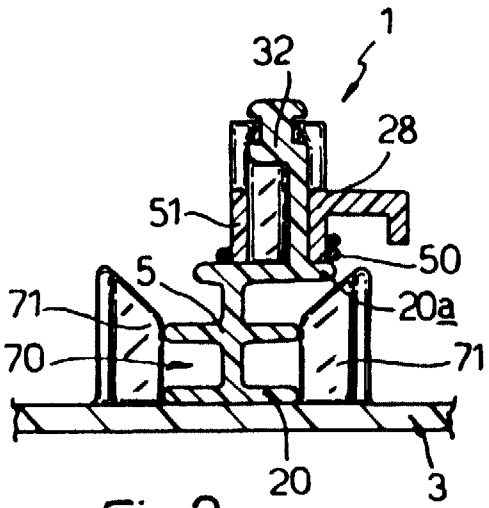
Figure 4:
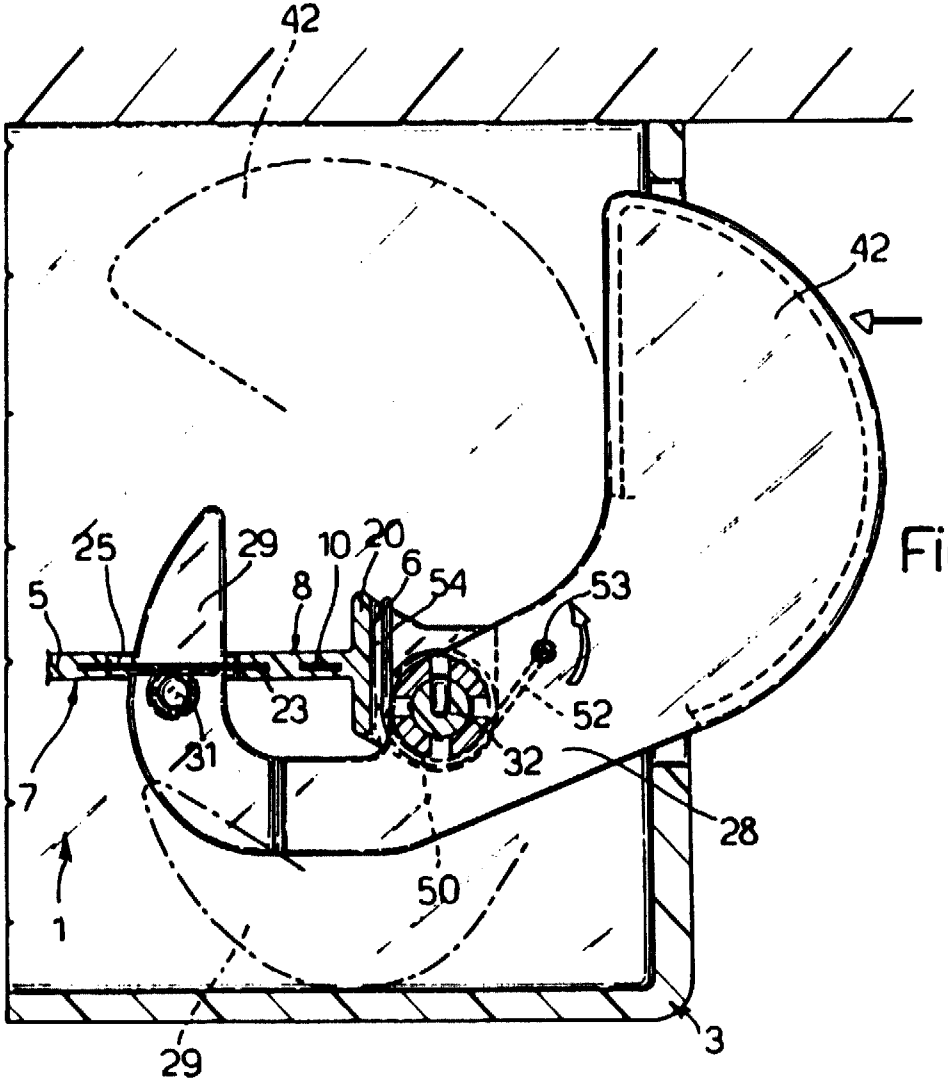

Lever 28 also has a second end 42, opposite end 29, which is larger in size and has the shape of a cam, and which is adapted to interact in a known fashion with a door (not illustrated for the sake of simplicity) of the household appliance upon which light-bulb holder 1 is mounted so as to cause, upon pushing the door in the direction indicated by means of the arrow (FIG. 4), such as, for example as a consequence of closing the door, a rotation of lever 28 in the counterclockwise direction to a second travel end position, illustrated diagramatically by means of the dashed line in FIG. 4, at which position the end 29 is removed from hole 25 (though still opposite it), and pin 31 is not in electrical contact with jumpers 23, 24. Rotation of lever 28 in the direction indicated by the arrow occurs against the action of the elastic or biasing means which, in the embodiment illustrated, consists of a helicoidal spring 50 wound coaxially around pin 32, and in particular around an engaging hub 51 of lever 28 as best seen in FIG. 3, and is permanently fixed at a first end 52 to the lever 28, by insertion within a hole 53 defined within lever 28 and, at a second end 54, to edge 6 of structure 5, in particular to an upper rib 20*a* of lower part or wing 22. Spring 50 is normally assembled in a partly loaded condition, so that it normally maintains keeps lever 28 in the first travel end position, with end 29 inserted within hole 25 and pin 31 in contact with bosses 40 of the jumpers or contacts 23 and 24.

In accordance with the invention, board structure 5 also comprises a cable clamping device 56 (FIGS. 1 and 2) defined by means of a pair of oblique elastically pliable fins 57, projecting sideways over peripheral edge 6 upon the side of surface 8 so as to be disposed at right angles with respect to lateral surfaces 7 and 8, and also projecting obliquely from bead 20, and converging towards each other and away from edge 6.

During use, the light-bulb holder 1 is easily obtained by molding the same or a single piece with the exception of lever 28, which is mounted later on together with spring 50. The holder is permanently assembled within box 3, for example by suitably shaping the lower part of edge 6 bounding lower wing 22, so as to make the wing adaptable for snapping into and/or locking within a slot 70 defined within box 3 by means of respective beads 71.

Light bulb 2 is thus inserted within sleeve 15, which is, for example equipped with a suitable thread, until its stem touches contacts 14, and in this manner, sectors 11 and 12 are electrically connected by means of light bulb 2. Upon terminals 30 the electrical supply wires (known and not illustrated) of the household appliance are cabled, the same passing into cable clamp 56, so as to prevent accidental disconnection due to traction or tension of the wires.

Figure 1:
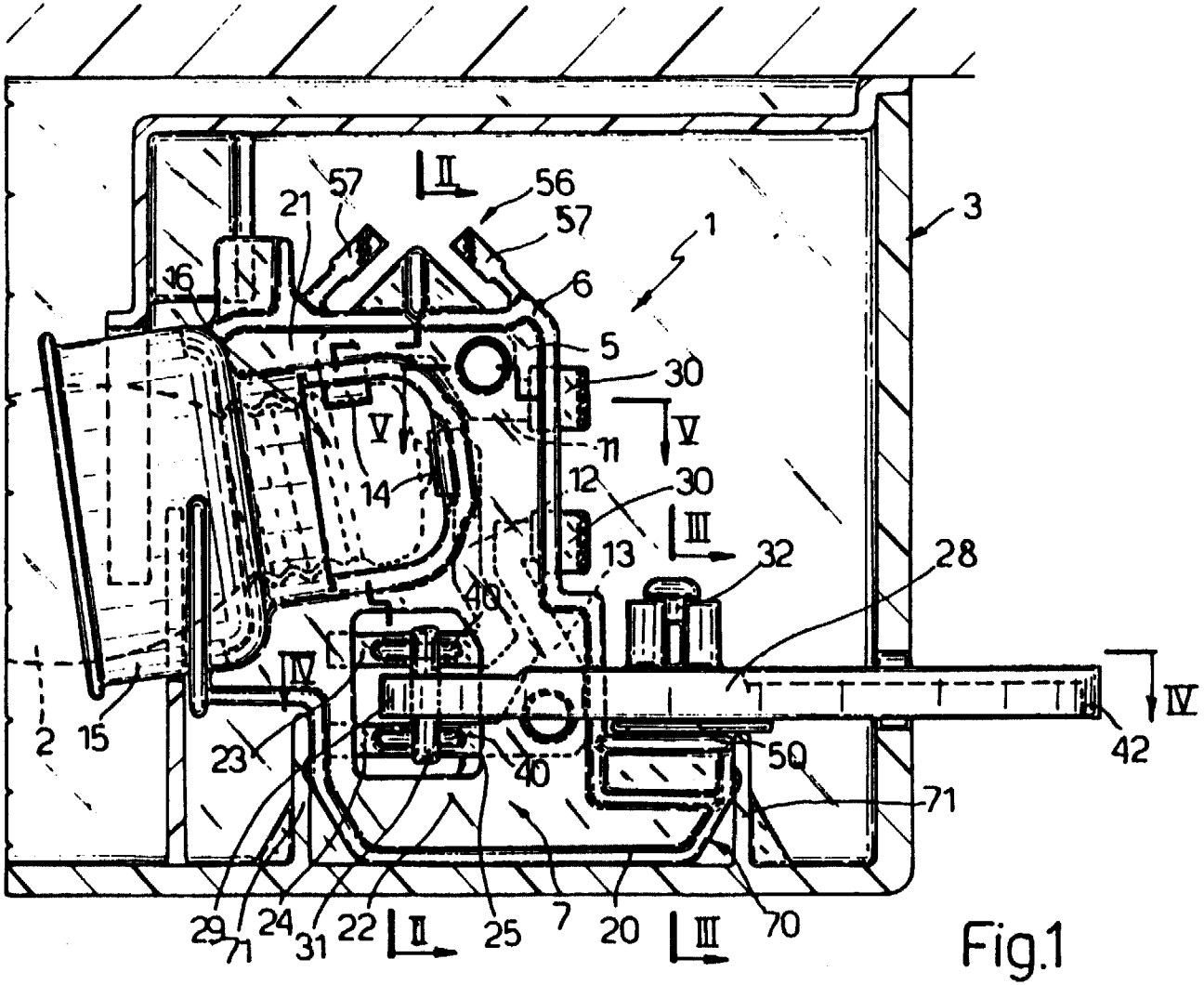
FIG. 1 is an elevated sectional view of the light-bulb holder constructed in accordance with the present invention.

With the household appliance door open, spring 50 maintains lever 28 in the position illustrated in FIG. 1, such that so pin 31 is positioned against contacts 23 and 24, forming an electrical connection between sectors 12 and 13, and under these conditions, the electrical current flows from terminals 30, through pin 31 and contacts 14, and through light bulb 2, thus switching it ON. When the door is closed, lever 28 is rotated against the action of spring 50 to the second travel end position shown in FIG. 4, pin 31 becomes disengaged from jumpers 23, 24 causing a break in the electrical circuit defined by means of sectors 11, 12 and 13, thus switching OFF light bulb 2. When the door is opened again, the elastic action of spring 50 moves lever 28 back to its initial position, switching light bulb 2 ON again.

Obviously, many variations and modifictions of the present invention are possible in light of the above teachings. It is therefore to be understood that within the scope of the appended claims, the present invention may be practiced otherwise than as specifically described herein.

What is claimed:

1. A light-bulb holder for household appliances, comprising:

a board structure fabricated from an electrically insulating material and bound by means of a peripheral edge and a pair of oppositely disposed lateral surfaces;

an electrically conductive plate divided into sections and adapted to define an electrical circuit including a pair of power supply contacts for a light bulb of said appliance, and disposed inside said board structure so as to be parallel to said oppositely disposed lateral surfaces;

electrical power supply means for said circuit; and a light-bulb holder sleeve integral with and projecting outwardly from said board structure in line with a first hole passing through said lateral surfaces of said board structure, said first hole communicating with the inside of said sleeve and housing said power supply contacts projecting internally into said first hole;

said electrical power supply means for said circuit comprises at least one pair of electrical plate terminals integral with said conductive plate and projecting outwardly from said board structure, a pair of second electrical contacts disposed inside a second hole passing through said surfaces of said board structure, and a pivotable lever pivotably mounted upon said board structure against the biasing action of an elastic means of said board structure about a fulcrum disposed substantially parallel to said lateral surfaces, said pivotable lever having a first end disposed in line with said second hole and equipped with an electrically conductive element which is disposed parallel to said fulcrum and being adapted, at a first travel end position of said lever, to come simultaneously into contact with both of said second electrical contacts.

2. A light-bulb holder as claimed in claim 1, wherein said second electrical contacts are disposed upon different sections of said electrically conducting plate including respectively at least one of said electrical plate terminals and at least one of said first electrical contacts.

3. A light-bulb holder as claimed in claim 1, wherein said peripheral edge is defined by means a bead projecting perpendicularly from both of said lateral surfaces, and in that said electrical terminals are defined by respective fins projecting at right angles from said bead, upon the side of said board structure opposite said light-bulb holder sleeve and parallel to said lateral surfaces, said fins having respective ends bent so as to project at right angles to one of said lateral surfaces.

4. A light-bulb holder as claimed in claim 3, wherein said board structure comprises a cable clamping device defined by means of a pair of oblique elastically pliable fins projecting over said peripheral edge of said board structure disposed so as to be at right angles to said lateral surfaces and to project obliquely from said bead defining said edge of said board structure, and thereby converge towards each other.

5. A light-bulb holder as claimed in claim 1, wherein said second electrical contacts are defined by means of a pair of parallel jumpers extending transversely right across said second hole and equipped, upon the side facing said pivotable lever, with respective bosses.

6. A light-bulb as claimed in claim 5, wherein said board structure has a substantially L-shaped elevational form, and said pivotable lever is defined by means a plate with a substantially asymmetrical C-shaped plan and disposed orthogonal to said board structure so as to be freely pivotable upon a pin which projects perpendicularly from said peripheral edge and which extends from a first wing of said L-shaped structure so as to be is parallel to a second wing of said L-shaped structure equipped with said first hole and said light-bulb holder sleeve.

7. A light-bulb holder as claimed in claim 6, wherein said pin is disposed substantially at the same height as said second hole, said first end of the lever being suitably shaped so as to fit through said second hole, between said jumpers, and having a conducting pin passing perpendicularly therethrough, and adapted to come into contact simultaneously with both of said jumpers when said lever is at said first travel end position; said lever having a second end, opposite the first end, shaped like a cam, and being connected to a first end of a helicoidal spring wound coaxially around said pin and permanently fixed, at a second end, to said peripheral edge of said board structure, said spring being adapted to maintain said lever at said first travel end position, with said first end of said lever inserted within the second hole.

8. A light-bulb holder as set forth in claim 7, wherein:

said cam-shaped second end of said pivotable lever has an arcuate cam surface for engaging a closure door of said household appliance when said closure door is moved from an OPEN position to a CLOSED position whereby said pivotable lever is moved from said first end travel position, at which said conducting pin is in contact with said jumpers so as to illuminate said light bulb to an ON state, to a second end travel position, against said biasing action of said helicoidal spring, at which said conducting pin is out of contact with respect to said jumpers so as to extinguish said light bulb to an OFF state.

* * * * *